US005220085A

United States Patent [19]

Cheng et al.

[11] Patent Number: 5,220,085

[45] Date of Patent: Jun. 15, 1993

[54] PREPARATION METHOD OF HIGH DENSITY FUELS BY THE ADDITION-REARRANGEMENT OF COMPOUND PENTACYCLO [7.5.1.$O^{2,8}$.$O^{3,7}$.-$O^{10,14}$] PENTADECANE ($C_{15}H_{22}$)

[75] Inventors: Sheng-San Cheng; Kou-Fu Liou; Ding-Ping Yen; Chun-Chen Liao, all of Taoyuan, Taiwan

[73] Assignee: Chung Shan Institute of Science and Technology, Taiwan, Taiwan

[21] Appl. No.: 897,245

[22] Filed: Jun. 11, 1992

Related U.S. Application Data

[63] Continuation-in-part of Ser. No. 714,444, Jun. 13, 1991, abandoned.

[51] Int. Cl.[5] ..... C10L 1/04; C07C 5/27

[52] U.S. Cl. ..... 585/14; 585/360; 585/747

[58] Field of Search ..... 585/353, 360, 371, 514, 585/547

[56] References Cited

U.S. PATENT DOCUMENTS 4,059,644 11/1977 Cannell ..... 585/10

4,401,837 8/1983 Burdette et al. ..... 585/253

4,762,092 8/1989 Yuasa et al. ..... 123/1 A

*Primary Examiner*—Asok Pal

*Assistant Examiner*—P. Achutamurthy

*Attorney, Agent, or Firm*—Scully, Scott, Murphy & Presser

[57] ABSTRACT

A method of preparing high density fuels by the addition-rearrangement of pentacyclo[7. 5. 1. $O^{2,8}$ . $O^{3,7}$ . $O^{10,14}$]pentadecane. The process comprises the steps of:

(a) reacting pentacyclo[7. 5. 1. $O^{2,8}$. $O^{3,7}$ . $O^{10,14}$]pentadecane with an adequate amount of super acid and solvent under inert gas condition to obtain a solution and maintaining at a reaction temperature of 0° C. to 200° C. and a pressure of about 1.0 atmosphere to about 100 atmospheres for a period of from about 10 minutes to about 100 hours to obtain a solution;

(b) stirring the solution for a suitable time to complete the addition-rearrangement reaction;

(c) separating the reaction mixture in water to obtain an aqueous layer and an organic layer.

(d) washing the organic layer with an alkali solution to eliminate any residual acid; and (e) purifying the organic layer by distillation to obtain the desired product.

7 Claims, 6 Drawing Sheets

PREPARATION METHOD OF HIGH DENSITY FUELS BY THE ADDITION-REARRANGEMENT OF COMPOUND PENTACYCLO [7.5.1.$O^{2,8}$.$O^{3,7}$.-$O^{10,14}$] PENTADECANE ($C_{15}H_{22}$)

CROSS-REFERENCE TO RELATED APPLICATION

This is a continuation-in-part of U.S. patent application Ser. No. 714,444 filed Jun. 13, 1991, now abandoned.

BACKGROUND OF THE INVENTION

This present invention relates to a preparation method for high density fuels by the addition rearrangement of the compound pentacyclo[7. 5. 1. $O^{2,8}$ . $O^{3,7}$ . $O^{10,14}$]pentadecane($C_{15}H_{22}$), in particular, by using a super acid as a novel catalyst to produce a series of hydrocarbon mixtures.

U.S. Pat. No. 4,059,644 discloses a process for making high density fuels by oligomerization of a mixture of cyclopentadiene dimer and methylcyclopentadiene dimer and methylcyclopentadiene dimer to produce their trimers and cotrimers followed by hydrogenation of the oligomerization product to obtain high density fuels. The trimers and cotrimers only constitute 40% of these oligomers. The density, melting point and net heat of combustion of the fuel mixtures are 1.02 g/ml, −30° C. and 154,000 BTU/gal, respectively.

U.S. Pat. No. 4,401,837 issued to Burdette et al. discloses a process for the preparation of a high density fuel consisting of exotetrahydrotricyclopentadiene (EXOTHTC)$C_{15}H_{22}$. In this method, endo-dicyclopentadiene as the starting material was used to produce trimers in a closed high temperature system. Then the trimers were catalytically hydrogenated and isomerizated to obtain high density exotetrahydrotricyclopentadiene fuel having the following properties: density: 1.0376 g/ml; freezing point: $<-40°$ C. and net heat of combustion: 155,522 BTU/gal.

High density fuel for airbreathing engines are especially useful in jet aircraft and missiles in order to provide greater efficiency to thus achieve greater range. High density fuel permits maximizing the range of these aircraft by providing higher energy per unit fuel volume.

To perform satisfactorily in such applications, the fuel must meet certain physical property requirements. This generally means that the fuel must have a melting point no greater than, if not substantially below −20° C. To provide high energy per unit volume, multiple ring compounds with a density approaching or exceeding 1.0 gm/ml must be employed.

SUMMARY OF THE INVENTION

The present invention is directed to hydrocarbon mixtures obtained from pentacyclo[7. 5. 1. $O^{2,8}$ . $O^{3,7}$ . $O^{10,14}$]pentadecane as a new high density fuel used in airbreathing engines.

It is another object of the present invention to provide a high density fuel for airbreathing engines in combination with mixtures of other high density fuels.

Another object of the present invention is to provide a new process for preparation of high density fuel useful in airbreathing engines.

A further object of the present invention is to provide a new, improved high density fuel useful in rocket engines providing greater flying range characterized by increased flash point to improve fuel safety.

These and other objects, advantages and features of the present invention will be more fully understood and appreciated by reference to the written specification.

BRIEF DESCRIPTION OF THE DRAWINGS

The invention will be better understood with reference to the drawings of which.

DETAILED DESCRIPTION OF THE INVENTION

Figure 1:
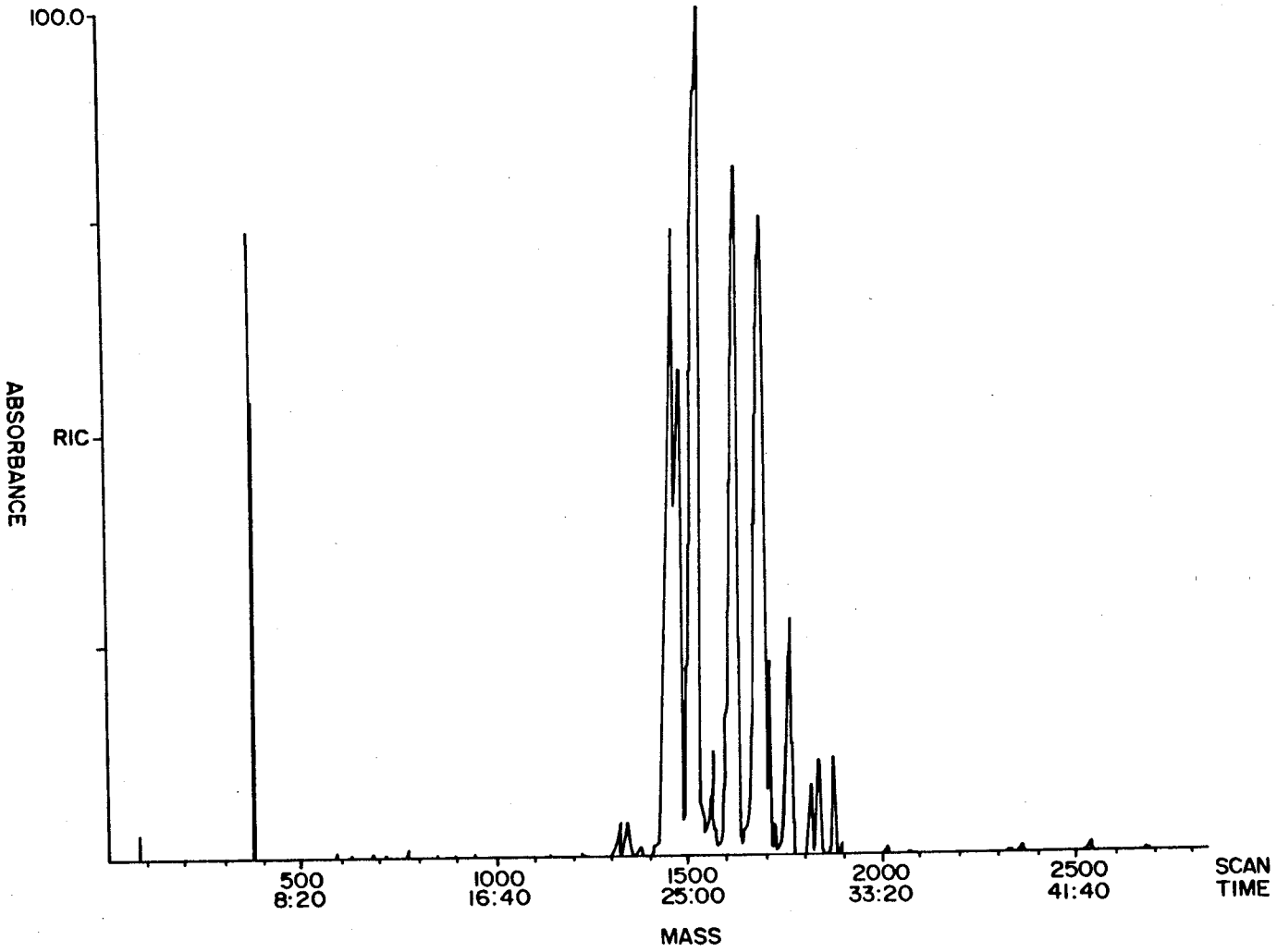
FIGS. 1 and 2 are gas chromatography spectra of the product hydrocarbon mixture.

The present invention relates to a method of preparing high density fuel by the addition-rearrangement of the compound pentacyclo[7. 5. 1. $O^{2,8}$ . $O^{3,7}$ . $O^{10,14}$]pentadecane ($C_{14}H_{22}$) using a super acid as a novel catalyst to form a series of hydrocarbon mixtures. The process in accordance with this invention comprises the steps of:

(a) reacting pentacyclo[7. 5. 1. $O^{2,8}$ . $O^{3,7}$ . $O^{10,14}$]pentadecane with a super acid, preferably trifluoromethanesulfonic acid, in a reactor under inert gas conditions at a reaction temperature of about 0° C. to about 200° C. and a reaction pressure of about 1.0 atmosphere to about 100 atmospheres for a period of from about 10 minutes to about 100 hours;

(b) stirring the reactants in the reactor for a suitable time to complete the addition-rearrangement reaction;

(c) separating the reaction mixture in water to obtain an aqueous layer and an organic layer;

(d) washing the organic layer with an alkali solution to eliminate any residual acid; and (e) purifying the organic layer by distillation to obtain the desired product.

The alkali solution used to neutralize the residual acid in the organic layer in the process according to the invention can be an aqueous solution of sodium hydrogen carbonate, sodium hydroxide and the like. The super acid is preferably introduced into the reactor in solution. The super acid solvent used is preferably selected from the group consisting of trichloromethane, dichloromethane, and methylbenzene which are known by those skilled in the art.

The purifying step of the present invention, to obtain the final hydrocarbon product, is accomplished by distillation, chromatography or other suitable purifying process. Preferably, distillation is used in the purification step of this invention.

In accordance with the present invention pentacyclo[7. 5. 1. $O^{2,8}$ . $O^{3,7}$ . $O^{10,14}$]pentadecane having the structural formula I,

I

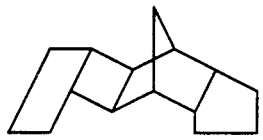

undergoes an addition-rearrangement reaction by contact with a super acid to obtain the desired hydrocarbon mixture.

The hydrocarbon mixture obtained in accordance with the present invention is an excellent high density fuel having the following properties: (1) high density; (2) high flash point; (3) high net heat of combustion; (4) good quality at a low temperature; and (5) excellent storage capability. This hydrocarbon mixture is used as a high density fuel for engines or rockets.

The synthesis of pentacyclo[7. 5. 1. $O^{2,8}$ . $O^{3,7}$ . $O^{10,14}$]pentadecane is a well-known in the art. It is disclosed in "Arno Behr and Nilhelm Keim Angew. Chem.", Int. Ed, 24(4), 314 (1985).

As stated above, the addition-rearrangement of pentacyclo[7. 5. 1. $O^{2,8}$ . $O^{3,7}$ . $O^{10,14}$]pentadecane requires a super acid, preferably trifluoromethanesulfonic acid. The amount of super acid used in the invention is about 0.01 to about 50.0 mole, preferably about 0.10 mole to about 20.0 moles per mole of pentacyclo-[7. 5. 1. $O^{2,8}$ . $O^{3,7}$ . $O^{10,14}$]pentadecane.

The yield of the hydrocarbon mixture product is maximized by adjusting the temperature and heating time during the addition-rearrangement reaction. In accordance with the present invention, the reaction temperature is about 0° C. to about 200° C., preferably, about 5° C. to about 100° C.; the reaction pressure is maintained between about 1.0 atmosphere to about 100.0 atmospheres, preferably, about 1.0 atmosphere to about 25.0 atmospheres and the reaction time is from about 10 minutes to about 100 hours, preferably, from about 20 minutes to about 50 hours.

The following examples are provided to illustrate the present invention. Because these examples are given for illustrative purposes only, the invention should not be limited thereto.

EXAMPLE 1

The reaction system is purged with nitrogen. 150 g (equivalent to 0.1 mole) of trifluoromethanesulfonic acid and 350 ml of dichloromethane are placed into 1 liter three-necked round flask. The solution is stirred thoroughly to enhance dissolution of trifluoromethanesulfonic acid in dichloromethane at room temperature. Subsequently, a solution of 50.0 g (equivalent to 0.25 mole) of pentacyclo-[7. 5. 1. $O^{2,8}$. $O^{3,7}$. $O^{10,14}$]pentadecane in 100 ml of dichloromethane is added through a feeding funnel to the trifluoromethanesulfonic acid solution in the reactor. The mixture is stirred for 24 hours at room temperature while nitrogen is passed through the solution. The reaction is thereupon stopped. One liter of aqueous sodium hydrogen carbonate solution is added to wash the organic layer and to neutralize the trifluorochloromethanesulfonic acid. Then anhydrous magnesium sulfate is introduced to remove water from the organic layer. The organic layer is next filtered and the organic solvent is removed by means of a rotary evaporator. After distillation at reduced pressure, 28.5 grams of a hydrocarbon mixture is obtained. Upon analysis of the mixture, the properties thereof are as follows: density: 0.995 g/ml; flash point: 125° C.; viscosity: 18.0 cSt at 20° C., 44.2 cSt at 0° C. and 153 cSt at −20° C.; melting point <−60° C.; and net heat of combustion (Hnet): 148,500 BTU/gal.

EXAMPLE 2

The hydrocarbon mixture product of Example 1, made in accordance with the present invention, is compared with known fuels as listed below.

| Mol. formula | JP-5 $C_{10}H_{19}$ | JP-10 $C_{10}H_{16}$ | RJ-5 $C_{14}H_{18.4}$ | Hydrocarbon Mixture |
|---|---|---|---|---|
| density (g/ml) | 0.788–0.845 | 0.936 | 1.06 min | 0.995 |
| flash point | 60 (min) | 55 min | 95 min | 125 |
| viscosity (cSt) at −40° C. | 14 | 17 | 2,000 | 1,025 |
| melting point | −46 (max) | −79 (max) | >−40 | >−60 |
| Hnet (BTU/gal) | 125,000 | 141,500 | 160,000 | 148,500 |
| & Hnet (BTU/gal) >JP-5 | 0 | 13.2 | 28 | 18.9 |

From the above table, it is found that the net heat of combustion of the hydrocarbon mixture obtained in accordance with the present invention is about 18.9% higher than that of conventional JP-5 fuel and about 5.0% higher than that of high energy fuel JP-10. Moreover, the density of the hydrocarbon mixture is approximate 1 which is also higher than that of JP-5 and JP-10. Testing indicates that the quality at low temperature of the hydrocarbon mixture is quite excellent. In particular, the flash point, which is an important criteria of the safety of a fuel, of the product obtained in the present invention is the highest of all the high density fuels tested. Accordingly, the safety of the fuel is good. As a result, it is concluded that the product obtained in accordance with the method of the present invention provides remarkable properties as measured by density, flash point, melting point, viscosity and the like.

EXAMPLE 3

The hydrocarbon mixture obtained in Example 1 was analyzed by gas chromatography-mass spectrometry. Specifically, a Hewlett-Packard [trademark] 5890A gas chromatography unit was employed. A separation column of SPB-1 50 m×0.25 m ID 0.25 m utilizing 3% OV-17 on 80/100 chromosorb WHP; a Flame Ionization Detector (FID) at a detecting temperature of 300° C.; an injection temperature of 175° C.; a separation initial column temperature of 135° C. and an initial time of 8 minutes; a heating rate of 5° C./min was employed up to a temperature of 145° C. at which time the heating rate was increased to 10° C./min until a temperature of 175° C. was reached, the final temperature was 175° C. and the final time was 9 minutes.

Figure 2:
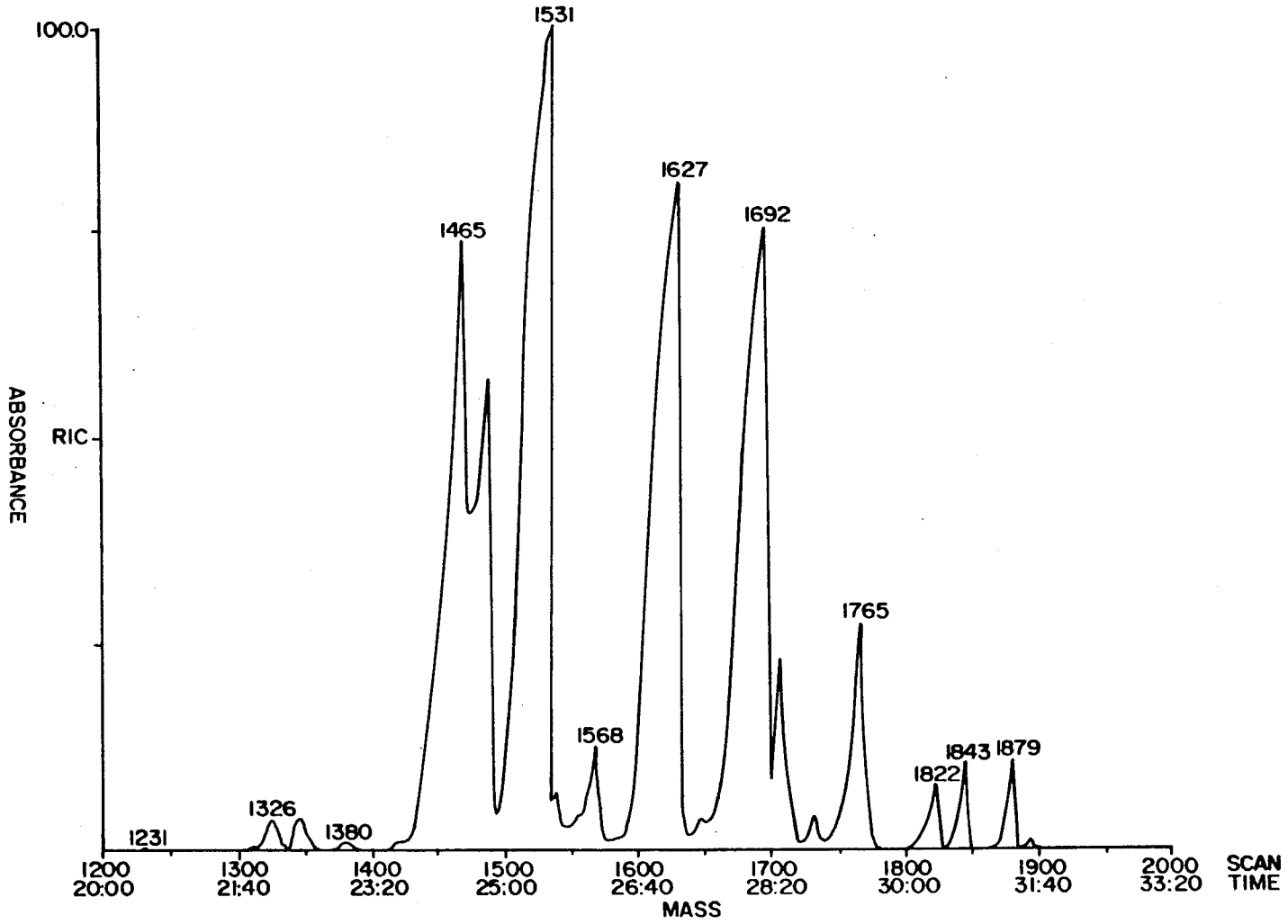

The resultant gas chromatography spectra is set forth in FIG. 1. A clearer depiction of FIG. 1 is included in FIG. 2 which enlarges the critical retention time period and excludes non-critical time periods. As noted in FIG. 2, there are 16 peaks, specifically at retention times of 1326, 1346, 1380, 1465, 1485, 1531, 1568, 1627, 1648, 1692, 1706, 1733, 1765, 1822, 1843 and 1879. Of these, the seven compounds, Compounds 1 to 7, with retention times of 1465, 1485, 1531, 1627, 1692, 1706 and 1765 are included below in the Table.

TABLE

| Compound | Retention time | Molecular formula | Mol. wt. |
|---|---|---|---|
| 1 | 1465 | $C_{15}H_{24}$ | 204 |
| 2 | 1485 | $C_{15}H_{24}$ | 204 |
| 3 | 1531 | $C_{15}H_{24}$ | 204 |
| 4 | 1627 | $C_{15}H_{24}$ | 204 |
| 5 | 1692 | $C_{15}H_{24}$ | 204 |
| 6 | 1706 | $C_{15}H_{24}$ | 204 |
| 7 | 1765 | $C_{15}H_{24}$ | 204 |

As indicated in the Table, the molecular weight of Compounds 1 to 7 are each 204, consistent with the molecular formula $C_{15}H_{24}$.

The compound depicted by the peak at 1568 is the reactant. Its molecular weight is 202 consistent with the molecular formula $C_{15}H_{22}$. The concentration of this compound in the hydrocarbon mixture was very low.

Compounds defined by the peaks at 1326, 1346, 1380, 1648, 1733, 1822, 1843 and 1879 are trace compounds. The compounds all have a molecular weight of 204.

An additional trace compound defines the peak at the retention time 1879. Its molecular weight is probably 204.

That the above conclusions are correct are established by mass spectrum plots for the compounds defined by all 16 peaks.

EXAMPLE 4

Figure 3:
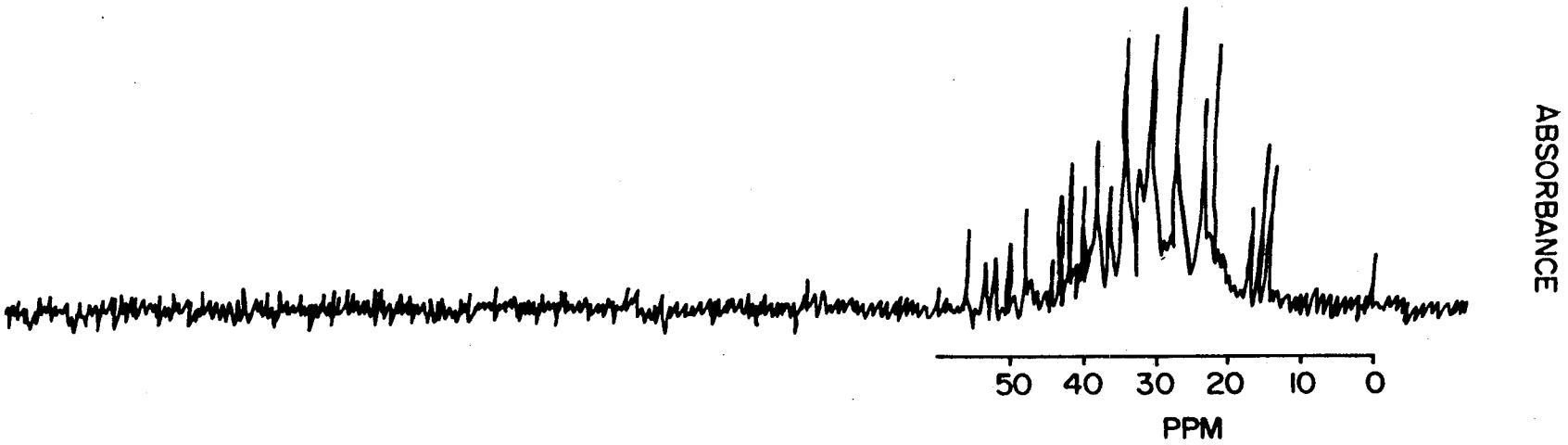
FIGS. 3 and 4 are $^{1}$H-NMR and $^{13}$C-NMR spectra, respectively, of the product hydrocarbon mixture.

The samples of the hydrocarbon product mixture of Example 1 were analyzed by $^1$H-NMR and $^{13}$C-NMR. The results of this analysis are included in FIGS. 3 and 4. FIG. 3 is the $^1$H-NMR spectrum of the hydrocarbon mixture and FIG. 4 is the $^{13}$C-NMR spectrum of the hydrocarbon mixture.

Figure 5:
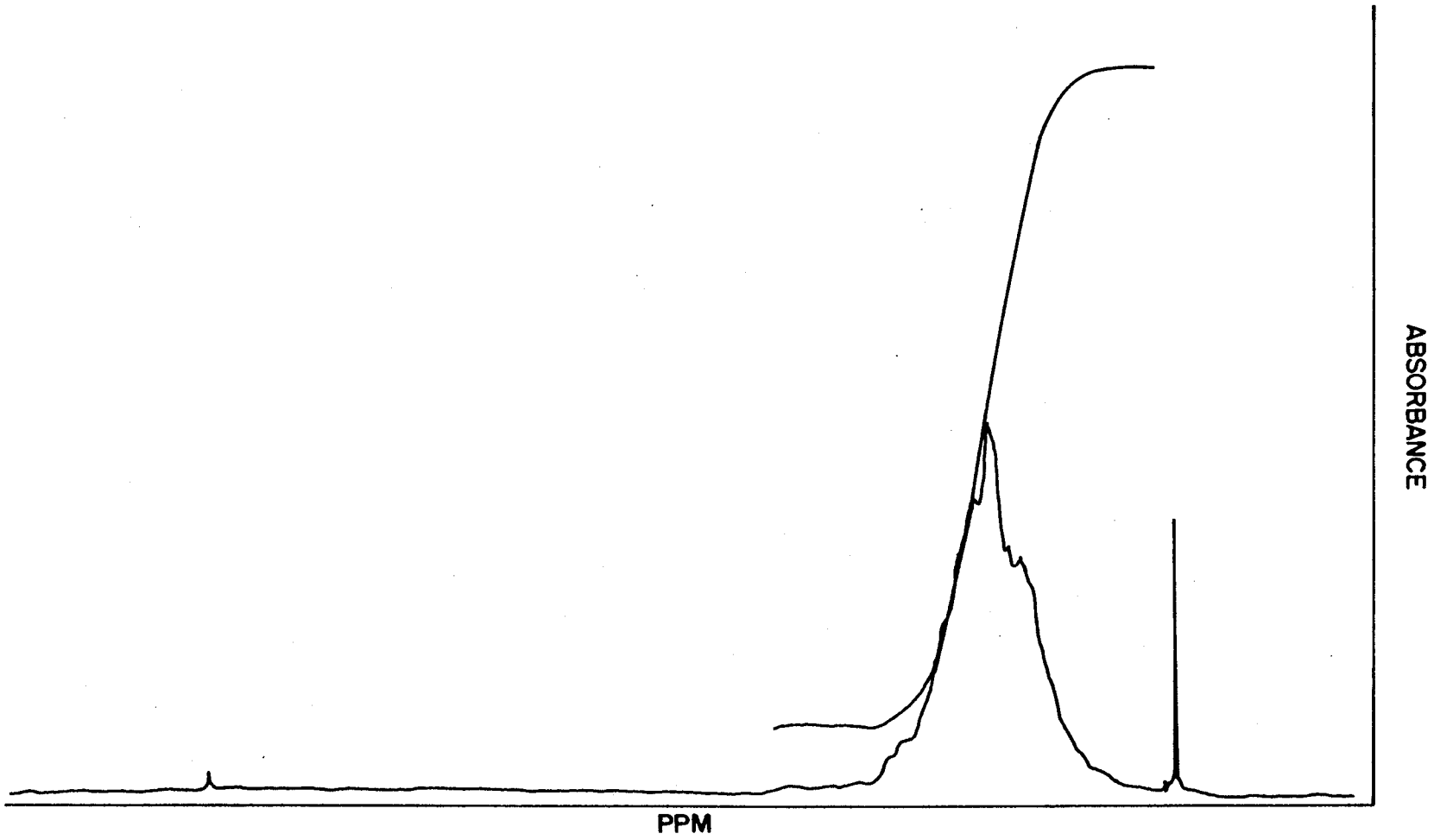
FIGS. 5 and 6 are $^{1}$H-NMR and $^{13}$C-NMR spectra, respectively of the $C_{15}H_{22}$ reactant.
Figure 6:
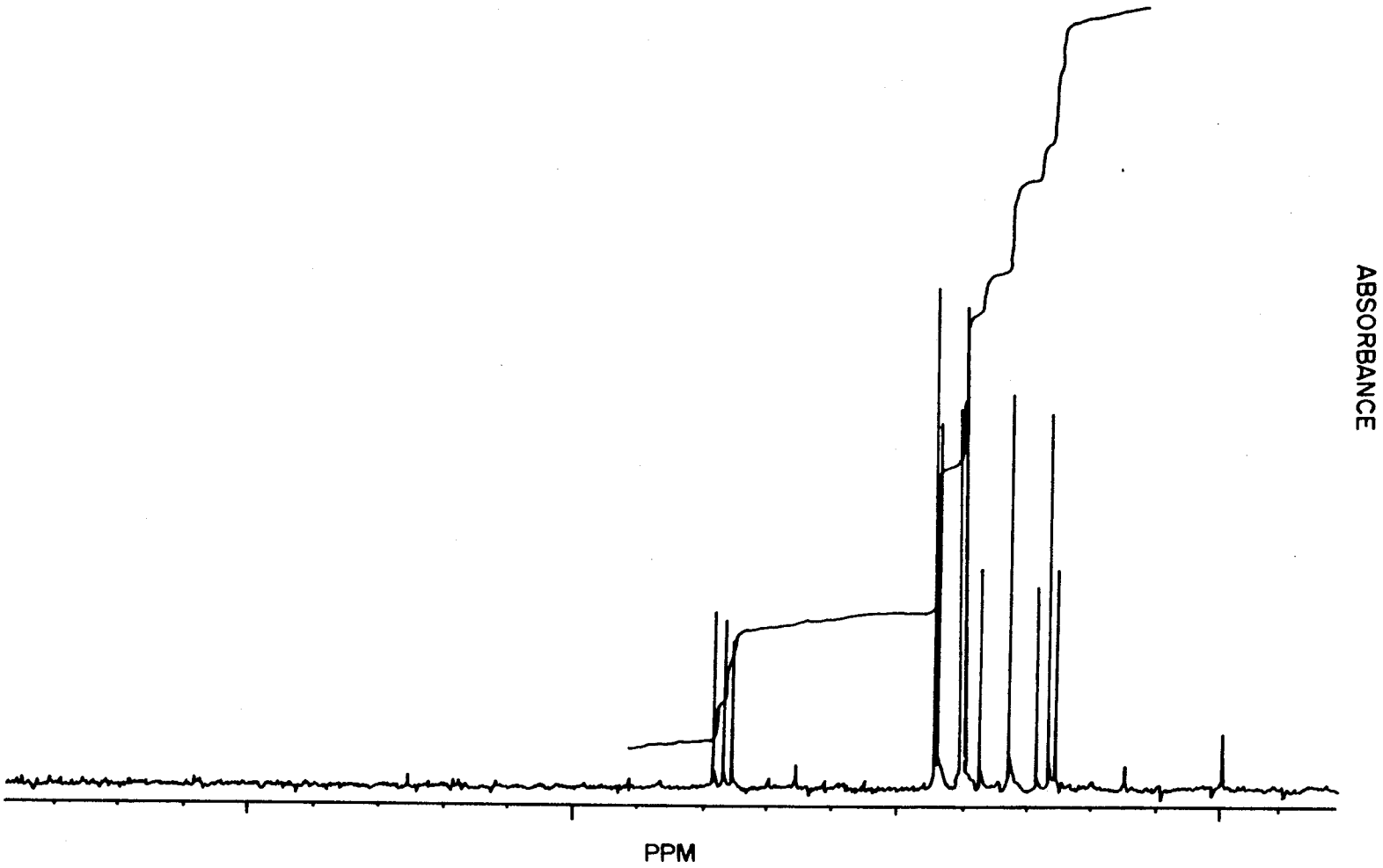

FIGS. 5 and 6 are provided for comparison. FIG. 5 is the $^1$H-NMR spectrum of the pentacyclo[7. 5. 1. $O^{2,8}$. $O^{3,7}$. $O^{10,14}$]pentadecane reactant having the molecular formula $C_{15}H_{22}$. FIG. 6 is the $^{13}$C-NMR spectrum of that reactant compound.

An analysis of FIG. 6 indicates the $^{13}$C-NMR spectrum is as follows: 44.639 ppm, 43.989 ppm, 40.847 ppm, 37.597 ppm, 33.208 ppm, 28.929 ppm, 26.870 ppm, 25,787 ppm.

Figure 4:
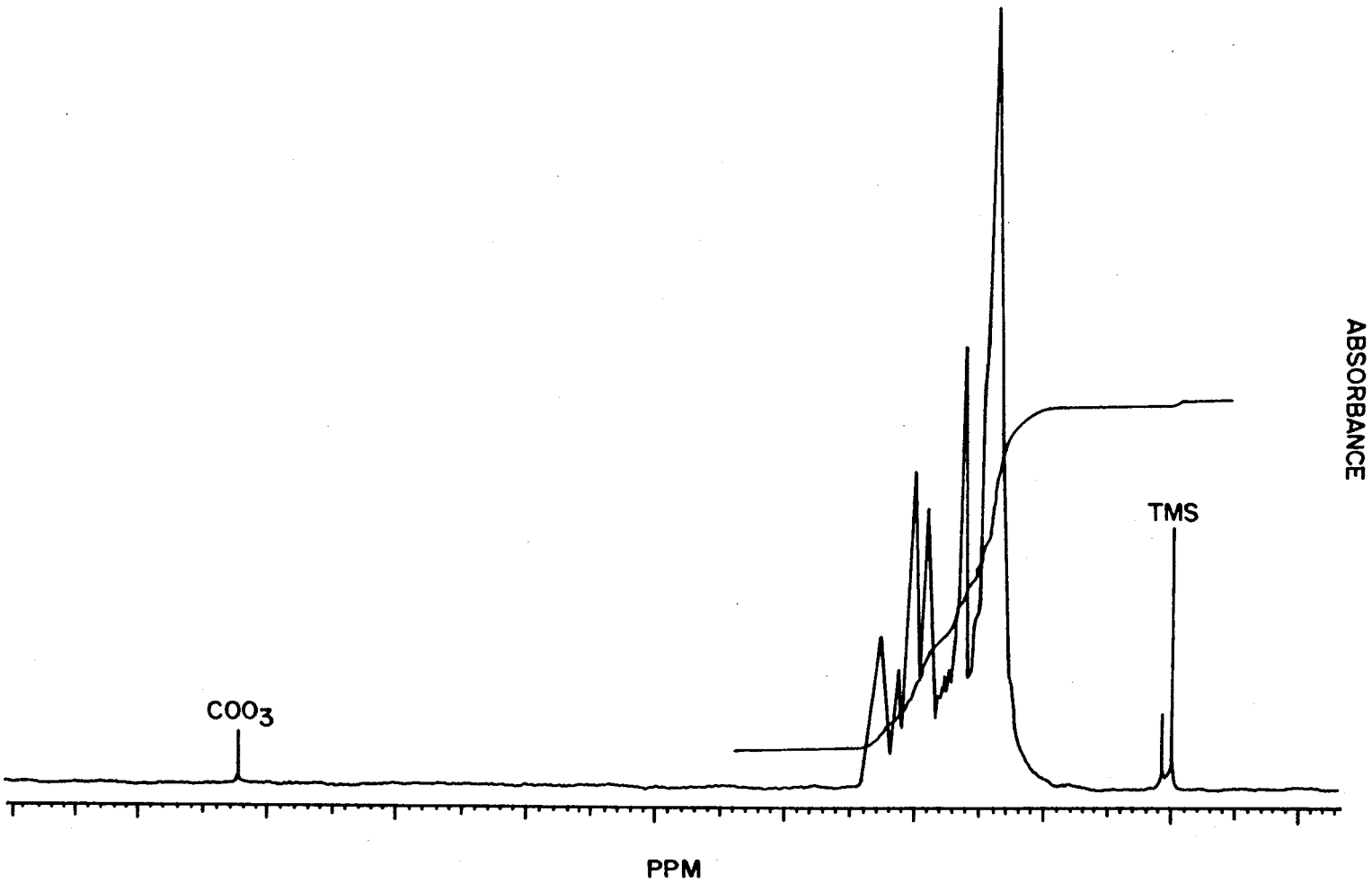

On the other hand, an analysis of FIG. 4 establishes the following $^{13}$C-NMR spectrum for the product hydrocarbon mixture: 56.016 ppm, 53,849 ppm, 48.186 ppm, 43.610 ppm, 41.985 ppm, 41.335 ppm, 40.360 ppm, 39.872 ppm, 39.601 ppm, 38.788 ppm, 38.409 ppm, 38.030 ppm, 37.542 ppm, 36.784 ppm, 36.296 ppm, 36.026 ppm, 34,563 ppm, 34.400 ppm, 34.129 ppm, 32.829 ppm, 32.667 ppm, 32.017 ppm, 31.746 ppm, 31.637 ppm, 31.204 ppm, 30.825 ppm, 30.716 ppm, 30.688 ppm, 30.229 ppm, 29.958 ppm, 28.549 ppm, 28.170 ppm, 27.683 ppm, 26.762 ppm, 26.328 ppm, 26.003 ppm, 24.053 ppm, 23.836 ppm, 23.295 ppm, 21.994 ppm, 16.902 ppm, 15.927 ppm, 15.060 ppm.

A comparison of the $^{13}$C-NMR spectrum of the hydrocarbon product mixture with the reactant establishes that they are completely different.

An analysis of the $^1$H-NMR spectrum of the hydrocarbon product mixture (FIG. 3) establishes that there are no double bonds in the compounds of the hydrocarbon product mixture. This is confirmed by a similar analysis of the $^{13}$C-NMR spectrum of the product mixture (FIG. 5). Therefore, the distinction between the product spectrum and reactant spectrum is not accounted for by unsaturation.

ANALYSIS OF THE HYDROCARBON PRODUCT

Examples 3 and 4 establish that the hydrocarbon product is a hydrocarbon having the molecular formula $C_{15}H_{24}$. Although the method of the present invention is independent of any theory explaining the mechanism by which this product is obtained, it is believed that at least four mechanisms, equally feasible, explain how the addition-rearrangement method of the present invention produces this desirable product.

The first proposed mechanism, consistent with the method defining the invention, is schematically represented by the following steps:

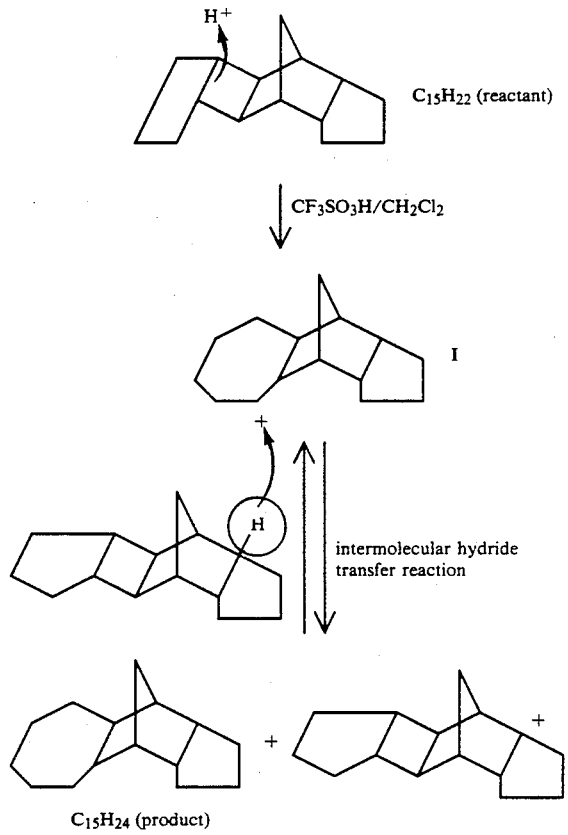

A second theoretically possible mechanism is as follows:

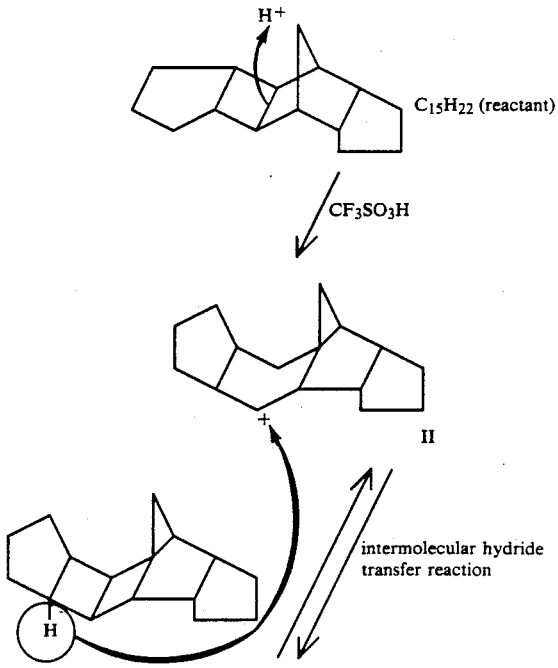

-continued

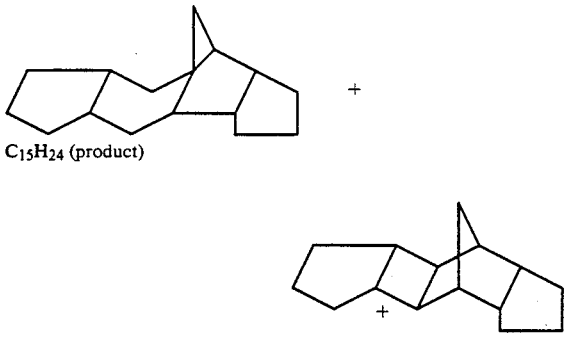

A third possible mechanism which explains the method of the present invention wherein the addition-rearrangement method of the present invention results in the formation of the $C_{15}H_{24}$ product is as follows:

or (3)

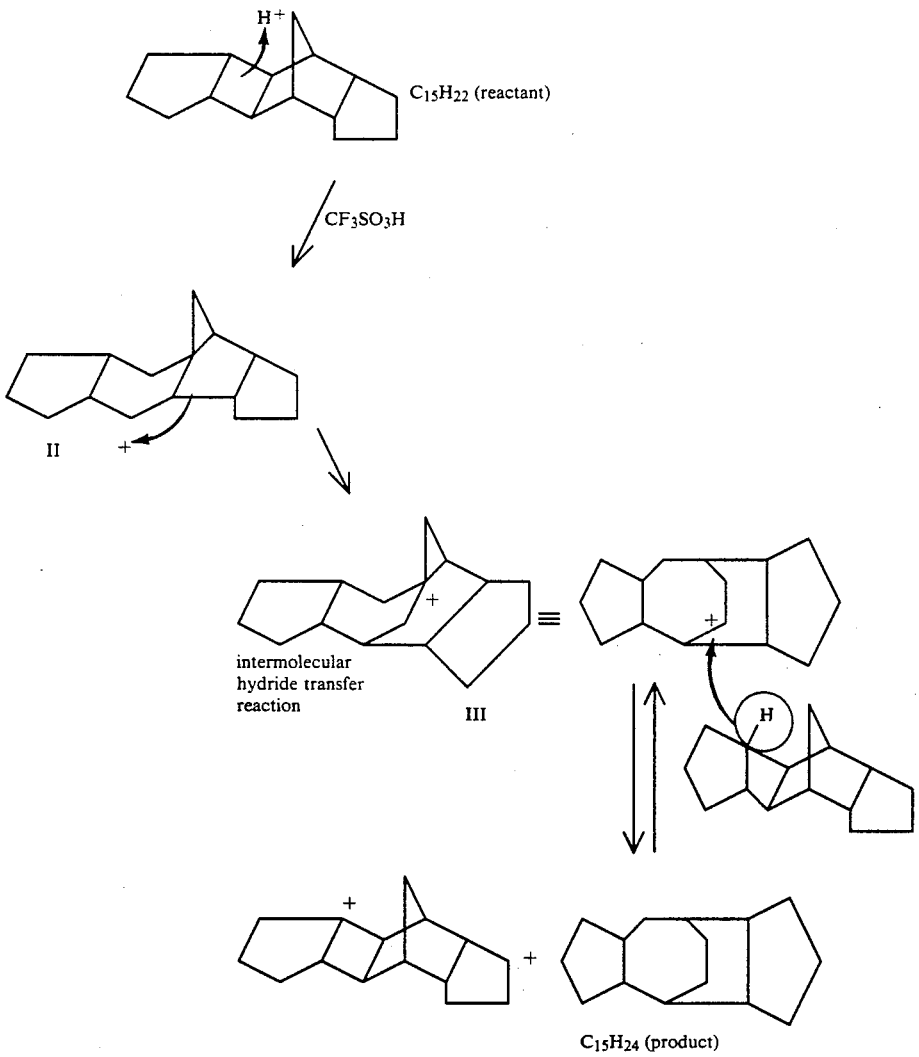

Yet a fourth possible mechanism involves the intermediates I, II and III of the first three mechanisms which are subjected to a hydride or C—C bond shift to form additional intermediates from which a high density fuel mixture of $C_{15}H_{24}$ hydrocarbons of various structures are formed. This proposed mechanism is illustrated by the following scheme:

I

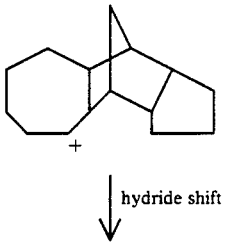

-continued

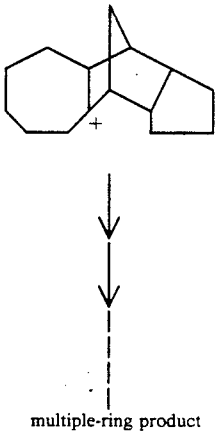

or

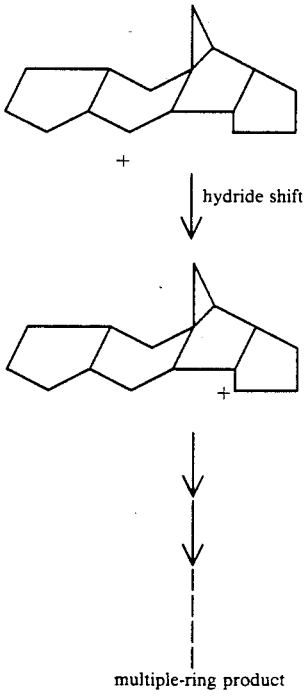

It is emphasized that if a ring-opening did not occur conventional skeleton rearrangement occurs. In such isomerization reactions the product would, of course, be isomers having the molecular formula $C_{15}H_{22}$.

The above embodiments and examples are given to illustrate the scope and spirit of the present invention. These embodiments and examples will make apparent, to those skilled in the art, other embodiments and examples These other embodiments and examples are within the contemplation of the present invention. Therefore, the present invention should be limited only by the appended claims.

What is claimed:

1. A method of preparing a high density fuel by the addition-rearrangement of pentacyclo-[7. 5. 1. $O^{2,8}$ . $O^{3,7}$ . $O^{10,14}$]pentadecane comprising the steps of:

(a) reacting pentacyclo[7. 5. 1. $O^{2,8}$ . $O^{3,7}$ . $O^{10,14}$]pentadecane in the presence of trifluoromethanesulfonic acid under inert gas conditions at a temperature of about 0° C. to about 200° C. and a pressure of about 1.0 atmosphere to about 100 atmospheres for a period of from about 10 minutes to about 100 hours to obtain a solution, (b) stirring the solution for a sufficient period of time to complete the addition-rearrangement reaction;

(c) separating the reaction mixture in water to obtain an aqueous layer and an organic layer;

(d) washing the organic layer with an alkali solution to eliminate any residual acid; and (e) purifying the organic layer by distillation to obtain the desired product.

2. A method in accordance with claim 1 wherein about 0.1 mole to about 20 moles of trifluoromethanesulfonic acid is present in step (a) per mole of pentacyclo[7. 5. 1. $O^{2,8}$ . $O^{3,7}$ . $O^{10,14}$]pentadecane.

3. A method in accordance with claim 1 wherein the reaction temperature is preferably in the range of from about 5° to about 100° C.

4. A method in accordance with claim 1 wherein the reaction pressure is preferably ranging from about 1.0 to about 25.0 atmosphere.

5. A method in accordance with claim 1 wherein the reaction time is preferably ranging from about 20 minutes to about 50 hours.

6. A method in accordance with claim 1 wherein the solvent is selected from the group consisting of trichloromethane, dichloromethane and methylbenzene.

7. A method in accordance with claim 6 wherein the solvent is dichloromethane.

* * * * *